US010279953B2

(12) United States Patent
Wei

(10) Patent No.: US 10,279,953 B2
(45) Date of Patent: May 7, 2019

(54) CONTAINER SEAL

(71) Applicant: Seal and Pack Co., LTD, Gyeonggi-do (KR)

(72) Inventor: Se Hwang Wei, Gyeonggi-do (KR)

( * ) Notice: Subject to any disclaimer, the term of this patent is extended or adjusted under 35 U.S.C. 154(b) by 79 days.

(21) Appl. No.: 15/133,772

(22) Filed: Apr. 20, 2016

(65) Prior Publication Data

US 2016/0332771 A1 Nov. 17, 2016

(30) Foreign Application Priority Data

May 11, 2015 (KR) ..... 10-2015-0065650
May 11, 2015 (KR) ..... 10-2015-0065651
May 11, 2015 (KR) ..... 10-2015-0065652

(51) Int. Cl.
*B65D 17/34* (2006.01)
*B65D 17/28* (2006.01)
*B65D 51/20* (2006.01)
*B65D 51/24* (2006.01)

(52) U.S. Cl.
CPC ..... *B65D 17/4012* (2018.01); *B65D 51/20* (2013.01); *B65D 51/245* (2013.01);
(Continued)

(58) Field of Classification Search
CPC .... B65D 17/165; B65D 51/20; B65D 51/245; B65D 2251/0015; B65D 2251/0093;
(Continued)

(56) References Cited

U.S. PATENT DOCUMENTS 4,572,393 A * 2/1986 Kobayashi ..... B65D 17/401 220/270
2007/0051690 A1 3/2007 Hidding
(Continued)

FOREIGN PATENT DOCUMENTS

JP 61-30621 2/1986
JP 6-19458 5/1994
(Continued)

OTHER PUBLICATIONS

International Search Report dated Jul. 28, 2016 in corresponding International Application No. PCT/KR2016/004028 (with English translation).

(Continued)

*Primary Examiner* — Fenn C Mathew
*Assistant Examiner* — Elizabeth J Volz
(74) *Attorney, Agent, or Firm* — Antonio Ha & U.S. Patent, LLC

(57) ABSTRACT

A container seal includes a top layer having an opening tab and a bottom layer thermally bonded to aluminum foil and a container. The top layer includes: first and second partial opening tabs; first and second opening guide-separating bands connected to the first and second partial opening tabs and extending along an inner edge of a container entrance so that the top layer and the bottom layer can be open along the inner edge of the container entrance when the first and second opening tabs are pulled; and a ring-shaped thermal bonding layer spaced from the first and second opening guide-separating bands by first and second separating lines and being in contact with a lip of the container outside the first and second opening guide-separating bands.

11 Claims, 21 Drawing Sheets

(52) U.S. Cl.
CPC ..... *B65D 2251/0015* (2013.01); *B65D 2251/0093* (2013.01); *B65D 2517/0013* (2013.01)

(58) Field of Classification Search
CPC ..... B65D 2517/0013; B65D 17/4011; B65D 17/4012; B65D 17/28; B65D 17/462
USPC ..... 222/541.9; 220/268, 270, 258.1, 258.2, 220/359.2, 359.3, 359.4, 276
See application file for complete search history.

(56) References Cited

U.S. PATENT DOCUMENTS

2011/0138742 A1* 6/2011 McLean ..... B65D 17/16 220/270
2012/0043324 A1* 2/2012 Baker ..... B65D 17/502 220/276
2012/0175370 A1* 7/2012 Walunis ..... B65D 51/20 220/258.1

FOREIGN PATENT DOCUMENTS

| | | |
|---|---|---|
| JP | 9-192 | 4/1997 |
| JP | 2004-106914 | 4/2004 |
| KR | 10-1455977 | 11/2014 |

OTHER PUBLICATIONS

The picture of the exhibition ($10^{th}$ medicine & cosmetic technology exhibition (Cophex 2015, Kintex), Applicant's exception of public disclosure: Apr. 21, 2015.

* cited by examiner

CONTAINER SEAL

BACKGROUND OF THE INVENTION

Field of the Invention

The present invention relates to a container seal for closing the entrance of a container made of plastic or glass etc. and, more particularly, a container seal that can open a portion or the entirety of the entrance of a container, and a method of manufacturing the container seal.

Description of the Related Art

Containers made of plastic or glass, etc. generally have an entrance for putting contents into or taking contents out of the container and, for products of those containers, the entrances of the containers should be sealed to protect the contents or prevent leakage of the contents during the distribution process. In order to seal the entrances of the containers, a cap, a cap with a shock-absorbing member inside, or a thermal seal that is thermally attached to the entrance of a container to seal the entrance are used.

An elastic foam packing made by foaming polyolefin-based polymer is used as the shock-absorbing member inside a cap and a conduction type heat-seal or a high frequency induction heating seal is used as the thermal seal.

Recently, thermal seals are generally used to completely seal containers.

FIGS. 1 and 2 show examples of thermal seals of the related art.

Referring to FIG. 1, a thermal seal 20 without an opening tab is configured such that a user can open the center portion of the thermal seal 20 by tearing the center portion with fingers or other tools.

In order to prevent the torn part 10 from being randomly torn or to prevent damage to the thermal seal, a user has to start separating with the edge of the entrance of the container and has to forcibly break the thermal seal because there is no opening tab to open the container. Accordingly, it is difficult to tear the seal, and even if the seal is easily torn, it is randomly torn, so the aesthetic appearance becomes poor and it is difficult to take out the contents for use.

As for a thermal seal for a container shown in FIG. 2, it is partially open such that a user can hold and separate the open part, but the entire entrance of the container is opened and there is no temper evident function, so reliability of the product may be doubted by customers and there is a problem in safety and protection of the contents that is a defect of a peelable seal. Further, when this thermal seal is used for drug containers, when a user takes out pills, several pills are poured out to the hand of the user and the excess pills are contaminated by bacteria on the hand. Further, powder contents such as coffee are also easily hardened or spoiled by moisture or oxygen that can easily flow inside through the wide entrance.

Documents of Related Art (Patent Document 1) Korean Patent Application Publication No. 10-2009-0003222 (publicated on Jan. 9, 2009)

(Patent Document 2) Korean Patent Application Publication No. 10-1984-0007700 (publicated on Dec. 10, 1984)

(Patent Document 3) Japanese Patent Application Publication No. P2012-81999 (published on Apr. 26, 2012)

SUMMARY OF THE INVENTION

An object of the present invention is to provide a thermal seal for a container that can open the entrance of a container partially or in the shape of a semicircle in the first step in accordance with the use and then open the entire entrance in the second step.

Another object of the present invention is to provide a thermal seal that can provide consumers with convenience, reliability, and safety by having a structure capable of being easily opened and providing certain temper evident with an opening trace left.

Another object of the present invention is to provide a container seal that can achieve a secondary sealing ability such as preventing the spoiling of contents by partially remaining with elasticity and shock-absorbing ability at the end of a container entrance even after being opened, and by preventing leakage of contents from a container and inflow of oxygen and moisture into the container using the elasticity and shock-absorbing ability when a cap is closed again.

A container seal according to an embodiment of the present invention for achieving the objects is shown in FIGS. 3 to 20.

In order to achieve the above object, according to one aspect of the present invention, there is provided a container seal adapted by sealing a container entrance by thermal bonding and opening the container entrance when an opening tab on a top thereof is pulled, the container seal including a top layer where the opening tab, a separating line, and an opening guide-separating band is formed and a bottom layer composed of an aluminum foil layer and a thermal bonding polymer layer and thermally bonded to the container. The top layer has a structure composed of a partial opening tab and a partial separating line for partial opening in a first step and has a full opening tab and a full separating line for full opening in a second step. The partial opening tab and the full opening tab are separated by the partial separating line for the first step. The partial opening tab and the partial separating line on the top layer allow the top layer and the bottom layer to be partially opened along the partial separating line when the partial opening tab is pulled. The full opening tab and the full separating line for the second step allow the other portion of the seal to be fully opened after the partial opening. A ring-shaped thermal bonding band is formed outside the partial separating line and the full separating line and is thermally bonded to a container. The partial separating line, the full separating line, and the ring-shaped thermal bonding band, except for the partial opening tab and the full opening tab, are thermally bonded to the bottom layer.

A partial opening-guide band may be included in accordance with the shape of partial opening in the first step. A semicircular partial opening guide-separating band having an appropriate width may be formed along the inner side of a semicircular partial separating line so that the seal can be easily opened by distributing a force for opening it because an opening area is relatively large when it is opened in a semicircular shape.

Several laser cut lines are orthogonally formed in advance only on a thermal bonding polymer layer using a carbon dioxide laser device to the thermal bonding polymer layer that is the lowermost layer at a position where the partial opening tab and the partial separating line for the first step meet each other, that is, a position where partial opening starts and a position where the partial separating line starts, whereby tensile strength of the thermal bonding polymer layer decreases. Accordingly, the thermal bonding polymer layer including aluminum foil of the bottom layer can be easily torn and opened even by small force when the opening tab is pulled.

As second and third embodiments of the present invention for achieving the objects, container seals shown in FIGS. 21 and 28 seal a container entrance by thermal bonding and easily open the container entrance when an opening tab is pulled.

The container seals include: a top layer where the opening tab, a separating line, and an opening guide-separating band are formed; and a bottom layer composed of an aluminum foil layer and a thermal bonding polymer layer and thermally bonded to a container. The container seals include a top layer where the opening tab is formed and a bottom layer thermally bonded to a container together with aluminum foil, wherein the top layer has one partial opening tab and is thermally bonded to the bottom layer.

When the partial opening tab is pulled up, the container seal can be partially opened along the opening guide-separating line.

The partial opening tab separated along the opening guide-separating line is separated from the container by a separating line.

In order to fully open the container seal after the partial opening tab is partially opened, a user has only to pull up the opening tab because an opening guide-separating band is open at the left and right sides.

The container seal may further include a ring-shaped thermal bonding band spaced from the opening guide-separating band by the opening guide-separating line and thermally bonded to a lip of a container outside the opening guide-separating band.

A company logo or a product name may be printed on the opening side that is secondarily opened except for the partially opening portion of the seal so that an advertising effect is maximized.

In order to easily tear and open an aluminum foil layer and a thermal bonding polymer layer of the bottom layer, a third opening guide-separating line is formed on the thermal bonding polymer layer of the bottom layer right under the portion where the partial opening tab and the opening guide-separating line is arranged at the position where opening starts.

Several laser cutting lines are orthogonally formed in advance only on a thermal bonding polymer layer using a carbon dioxide laser device to the thermal bonding polymer layer that is the lowermost layer at a position where the partial opening tab and the partial separating line meet each other, that is, a position where partial opening starts and a position where the partial separating line starts, whereby tensile strength of the thermal bonding polymer layer decreases. Accordingly, the thermal bonding polymer layer including aluminum foil of the bottom layer can be easily torn and opened even by small force when the opening tab is pulled.

According to another aspect of the present invention, there is provided a method of manufacturing a container seal that seals a container entrance by thermal bonding, opens the container entrance when an opening tip on a top thereof is pulled, and includes a top layer where the opening tab is formed and a bottom layer thermally bonded to aluminum foil and a container, the top layer being thermally bonded to the bottom layer. The method includes: a first step of forming a thermal bonding band by cutting a partial opening tab, an opening guide-separating line, a separating line, an opening guide-separating band, and an outermost separating line; a second step of removing unnecessary portion of the top layer formed in the first step; and a step of thermally bonding the top layer prepared in the second step to the bottom layer.

Container seals according to fourth and fifth embodiments of the present invention for achieving the object that seals a container entrance by thermal bonding and easily opens the container entrance when an opening tab on the top thereof is pulled are shown in FIGS. 29 to 36. The container seals include; a top layer where the opening tab, a separating line, and an opening guide-separating band are formed; and a bottom layer composed of an aluminum foil layer and a thermal bonding polymer layer and being thermally bonded to the top layer. The container seals include a top layer where the opening tab is formed and a bottom layer thermally bonded to a container together with an aluminum foil layer, in which the top layer has one partial opening tab and is thermally bonded to the top layer.

When the partial opening tab is pulled up, the container seals start partially opening along the opening guide-separating line and partially open in a semicircular shape along the separating line.

The partial opening tab separated along the opening guide-separating line is separated from the container by a separating line.

Further, the opening guide-separating band forms the other semicircle to fully open the container seal after the partial opening tab is partially opened, so the container gear is fully opened by pulling up any portions of the opened side.

A company logo or a product name may be printed on the opening side that is secondarily opened except for the partially opening portion of the seal so that an advertising effect is maximized.

In order to easily tear and open an aluminum foil layer and a thermal bonding polymer layer of the bottom layer, a third opening guide-separating line is formed on the thermal bonding polymer layer of the bottom layer right under the portion where the partial opening tab and the opening guide-separating line is arranged at the position where opening starts.

Several laser cut lines are orthogonally formed in advance only on a thermal bonding polymer layer using a carbon dioxide laser device to the thermal bonding polymer layer that is the lowermost layer at a position where the partial opening tab and the partial separating line meet each other, that is, a position where partial opening starts and a position where the partial separating line starts, whereby tensile strength of the thermal bonding polymer layer decreases. Accordingly, the thermal bonding polymer layer including aluminum foil of the bottom layer can be easily torn and opened even by small force when the opening tab is pulled.

According to another aspect of the present invention, there is provided a method of manufacturing a container seal that seals a container entrance, opens the container entrance when an opening tab on a top thereof is pulled, and includes a top layer where the opening tab is formed and a bottom tab thermally bonded to aluminum foil and a container, the top layer being thermally bonded to the bottom layer. The method includes: a first step of forming a thermal bonding layer by separating a partial opening tab for opening a half of the container, an opening guide-separating line, a separating line, an opening guide-separating band, and an outermost separating line on the top layer; a second step of maintaining a half of the top layer for printing in the first step and removing unnecessary portions from the thermal bonding band by cutting the partial opening tab, the opening guide-separating band defined by the opening guide-separating line and the separating line, and an outermost separating line; and a step of thermally bonding the top layer prepared in the second step to the bottom layer.

Since the container seal of the present invention has a structure that can partially open a container entrance in a first step, and if necessary, can fully open the container entrance in a second step, it is possible to partially open a container entrance in a first step and fully open it in a second step.

Since the container seal according to the present invention has an opening tab, a separating line, an opening guide-separating line, and an opening guide-separating band, it is possible to easily and cleanly open the entrance of a container.

According to the container seal of the present invention, it is possible obtain a primary sealing effect before opening a container and the container seal partially remains at the lip of a container entrance even after the container is opened, so when a container is closed again by a cap, the container and the cap are brought in close contact with each other by elasticity and shock-absorbing ability of the container seal. Accordingly, it is possible to achieve a secondary sealing effect that prevents inflow of oxygen and moisture, in addition to leakage of contents.

Further, according to the container seal of the present invention, since is it possible to print a company logo or advertisement of a product in the area except for the partial opening tabs on the top of the seal, an advertising effect can be maximized until a user uses up the contents in the container after removing the partial opening tabs.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 8:
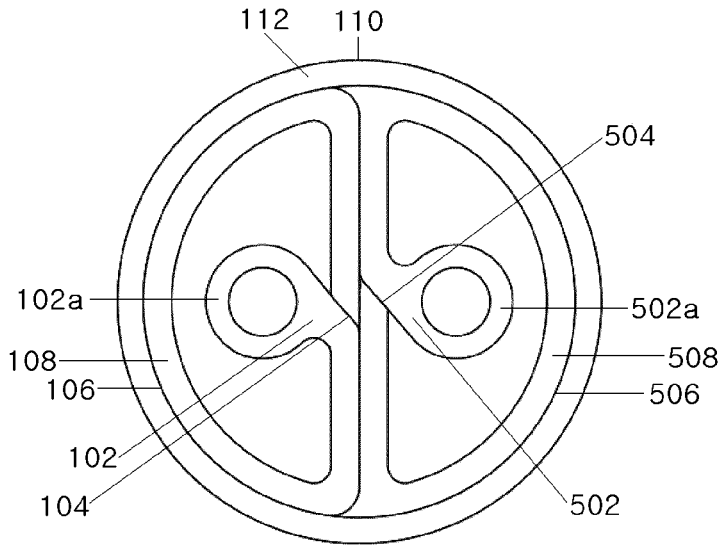
FIG. 8 is a view showing a top layer of a container seal according to a first embodiment of the present invention.
Figure 9:
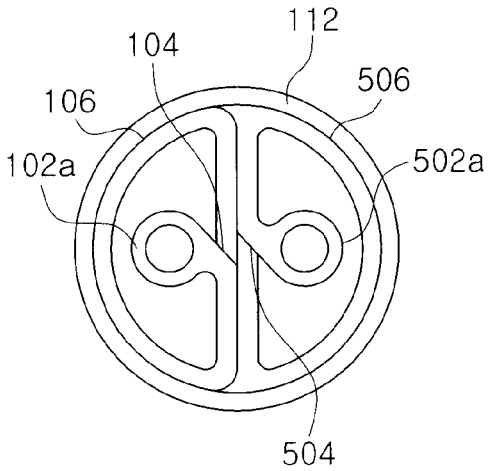
FIGS. 9 to 11 are views sequentially showing a process of opening a container seal 100 according to the present invention.

A preferred embodiment of the present invention is shown in FIGS. 8 and 9, which show the structure of a container seal.

Referring to FIG. 8, a top layer of a thermal seal according to the present invention includes: first and second partial opening tabs 102 and 502, first and second partial opening guide-separating lines 104 and 504, first and second partial separating lines 106 and 506, first and second partial opening guide-separating bands 108 and 508, an outermost separating line 110, and a thermal bonding band 112. That is, the first and second partial opening guide-separating lines 104 and 504, the first and second partial separating lines 106 and 506, and the outermost separating line 110 are formed on the top layer 300 shown in FIG. 5 and then unnecessary portions are cut off such that the first and second partial opening tabs 102 and 502, the first and second opening guide-separating bands 108 and 508, and the thermal bonding band 112 remain.

The top layer 300 where the first and second partial opening tabs 102 and 502, the first and second partial opening guide-separating lines 104 and 504, the first and second partial separating lines 106 and 506, the first and second opening guide-separating bands 108 and 508, and the thermal bonding band 112 are formed is thermally bonded to a bottom layer 400.

It can be seen that the first and second partial opening tabs 102 and 502 are formed at the left and right halves of the top, respectively.

Further, it can be seen that the first and second partial opening tabs 102 and 502 are formed symmetrically with the center point of the top therebetween.

Obviously, several opening tabs and various shapes of opening tabs may be provided, if necessary.

Referring to FIG. 8 again, thermal bonding is performed only on the thermal bonding band 112 that is bonded to an actual container and the first and second partial opening guide-separating bands 108 and 508, except for the first and second partial opening tabs 102 and 502. As described above, the top layer 300 and the bottom layer 400 are thermally bonded only at the first and second partial opening guide-separating bands 108 and 508 and the thermal bonding band 112, and then the container seal 100 is achieved by performing cutting or punching along the outermost separating line 110 to meet the standard of the container.

Hereinafter, configuration and operation of the present invention are described in detail with reference to the accompanying drawings.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the terms to describe most appropriately the best method he or she knows for carrying out the invention.

The present invention provides a container seal that has high thermal-bonding ability, thermal resistance, and opening ability by having opening tabs and separating lines for easily opening the entrance of a container.

Further, the present invention provides a container seal that keep a container and a cap in close contact with each other by partially remaining on the entrance of the container even after the entrance of the container is opened by an opening tab.

Figure 1:
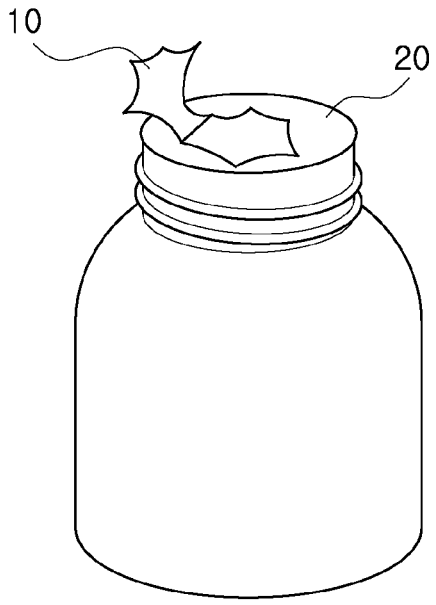
FIGS. 1 and 2 show examples of thermal seals of the related art.
Figure 2:
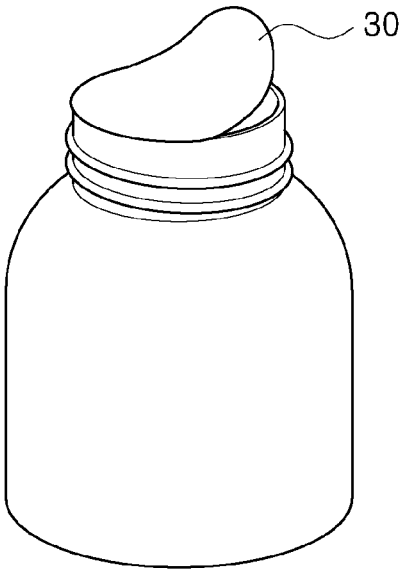
Figure 3:
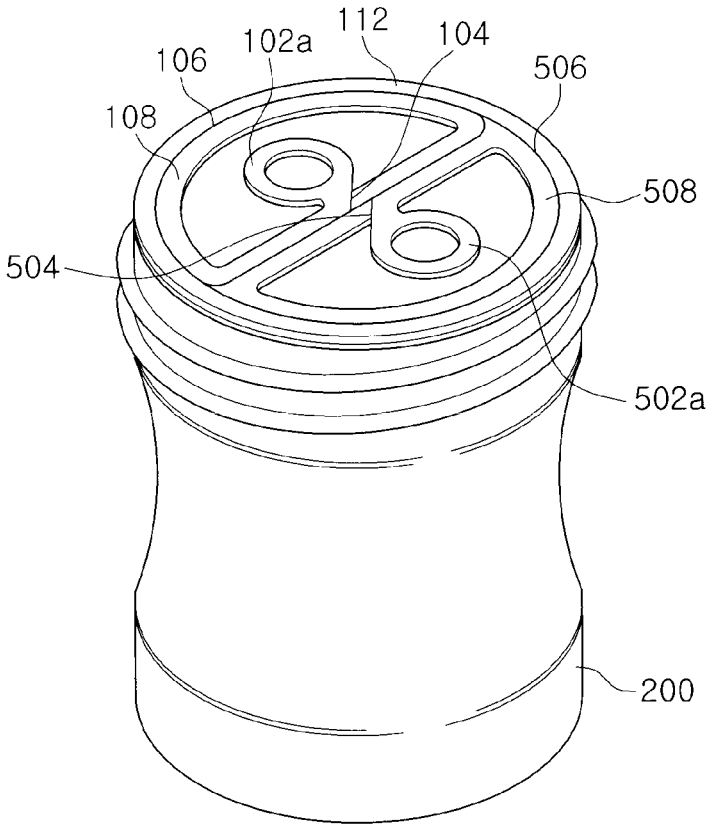
FIG. 3 is a perspective view showing a container seal according to an embodiment of the present invention applied to a container.

FIG. 3 is a perspective view showing a container seal according to the present invention that has been applied to a container.

Referring to FIG. 3, the entrance of a container 200 is sealed by a container seal 100 according to the present invention.

Figure 4:
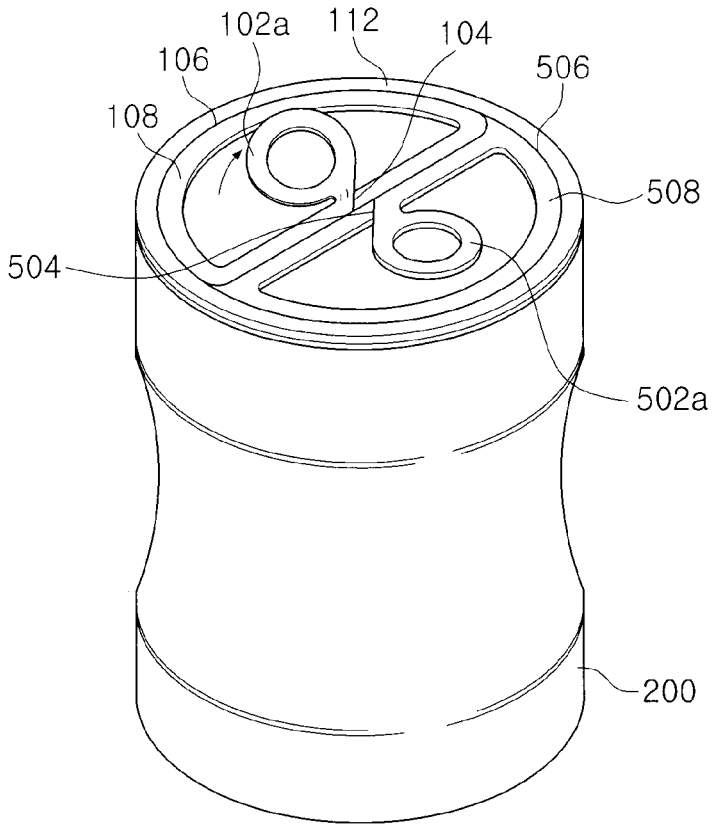
FIG. 4 is a view the container seal according to the present invention when an opening tab is pulled to open the entrance of the container.

FIG. 4 is a view the container seal according to the present invention when an opening tab is pulled to open the entrance of the container.

Referring to FIG. 4, when an upper portion 102*a* of the first partial opening tab 102 on the container seal 100 is pulled, the container seal 100 is partially separated along the first partial opening guide-separating band 108 formed along the inner edge of the entrance of a container 200.

Thereafter, when an upper portion 502*a* of the second partial opening tab 502 on the container seal 100 is pulled, the remaining portion of the container seal 100 is separated along the second partial opening guide-separating band 508 formed along the inner edge of the entrance of the container 200.

The opening process may be divided into several steps more than two steps.

Figure 5:
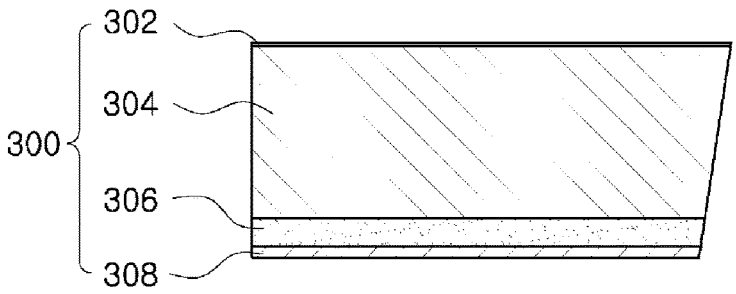
FIGS. 5 to 7 are views showing a process of making a container seal according to the present invention.
Figure 6:
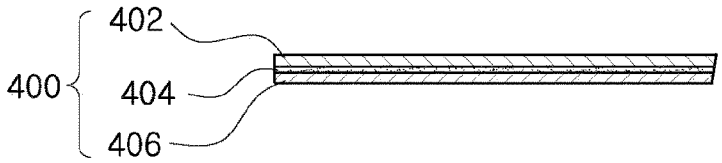
Figure 7:
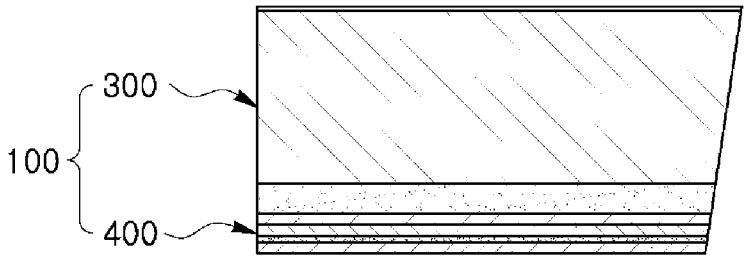

FIGS. 5 to 7 are views showing a process of making a container seal according to the present invention.

Referring to FIGS. 5 to 7, the container seal 100 according to the present invention is achieved by forming the top layer 300 with the first and second partial opening tabs 102 and 502 and the bottom layer 400 having thermal resistance and then thermally bonding the top layer 300 and the bottom layer 400, which will be described below.

The top layer 300 is made of various types of plastic film or foam. A surface layer 302 that is the uppermost layer in FIG. 5 is a polyester film or a polypropylene film having a thickness of 0.012 to 0.05 mm without thermal adhesiveness. If necessary, printing may be performed on the surface layer 302.

An intermediate layer 304 under the surface layer 302 is a film or a sheet made of polyolefin-based foam having a thickness of 0.1 to 2 mm and is laminated to the surface layer 302.

When a cap and the container 200 are combined, close contact between the cap and the container 200 is enhanced by elasticity of the intermediate layer 304. Further, when the intermediate layer 304 is a foam sheet having an appropriate thickness, it shows an isolation function that prevents heat from transferring to the surface layer 302 shown in FIG. 5 when heat is generated from an aluminum foil 404 of the bottom layer 400 shown in FIG. 6 by high-frequency induction heating. Accordingly, deformation of a cap or printed characters due to heat generated by thermal bonding is prevented.

A polyester film layer 306 having an appropriate thickness (0.03 to 0.2 mm) is laminated on the bottom of the intermediate layer 304 shown in FIG. 5. The polyester film 306 has a very important role. That is, the polyester film has high tensile strength and gives the high tensile strength to the entire top layer 300, so the opening tops and the ring shaped opening guide-separating band on the top layer that are integrally formed are not separated by a force for removing thermal bonding to aluminum to open the seal. The opening guide-separating band and the thermal bonding band on the top layer 300 including the polyester film 306 that has already been cut are thermally bonded to the thermal bonding layer including aluminum of the bottom layer 400 show in FIG. 7, so when the opening tabs on the top layer 300 are pulled for primary opening and secondary opening to remove the container seal applied to the container 200, the aluminum layer and the thermal bonding layer of the bottom layer are pulled upward. In this process, force is alternately applied to both sides of the separating line on the top layer that has already been cut, in which the aluminum foil layer and the thermal bonding layer of the bottom layer under the sides are pulled upward and then stopped by the polyester film having high rigidity at a predetermined point of time, and the aluminum foil layer and the thermal bonding layer of the bottom layer start to be torn, whereby opening is started.

The top layer and the bottom layer are bonded in two ways.

First and second thermal adhesive polymer having thermal adhesiveness and a thickness of 0.02 to 0.06 mm is laminated on the lower surface 308 under the polyester layer 306 of the top layer and the upper surface 402 of the aluminum foil layer of the bottom layer and then the top layer and the bottom layer are thermally bonded by heat of 150 to 250° C. under pressure. The first thermal adhesive polymer layer 308 laminated on the bottom of the top layer is made of film having high thermal adhesiveness and the second thermal adhesive polymer layer 402 made of the same material as the first thermal adhesive polymer layer is formed on the top of the bottom layer.

A polyolefin-based polymer film made of polyethylene polymer or polypropylene polymer having a thickness of 0.02 to 0.05 mm is used for the first thermal adhesive polymer layer 308 and the second thermal adhesive polymer layer 402.

The thermal bonding layer 406 is formed under the aluminum foil 404 by laminating a film having thermal adhesiveness or coating the material to a container.

When the container 200 is made of polypropylene, the thermal bonding layer 406 is made of a thermal adhesive polypropylene film having an appropriate thickness of 0.03 to 0.1 mm. When the container 200 is made of glass, polyethylene, or polyethylene terephthalate, a film or a polymer made of polyethylene, Polyethylene terephthalate, ionomer, or ethylene vinyl acetate is formed by coating in accordance with the material of the container.

The container seal 100 is achieved by thermally bonding the top layer 300 and the bottom layer 400. That is, the first partial opening tab 102, the second partial opening tab 502, the first and second partial separating lines 106 and 506, the ring-shaped first and second partial opening guide-separating bands 108 and 508, and partial opening guide-separating bands for partial opening are formed on the top layer 300 and then the top layer 300 is thermally bonded to the bottom layer 400.

In order to easily tear and open the aluminum foil layer and the thermal bonding polymer layer of the bottom layer, a third separating line is formed horizontally or orthogonally using a laser device only on the thermal adhesive layer under the separating line where the partial opening tab and the partial separating line meet each other and opening is started.

FIG. 8 shows the structure of a completed container seal according to the present invention.

Referring to FIG. 8, an upper layer of a thermal seal according to the present invention includes: first and second partial opening tabs 102 and 502, first and second partial opening guide-separating lines 104 and 504, first and second partial separating lines 106 and 506, first and second partial opening guide-separating band 108 and 508, an outermost separating line 110, and a thermal bonding band 112. That is, the first and second partial opening guide-separating lines 104 and 504, the first and second partial separating lines 106 and 506, and the outermost separating line 110 are formed on the top layer 300 shown in FIG. 4 and then unnecessary portions are cut off such that the first and second partial opening tabs 102 and 502, the first and second opening guide-separating bands 108 and 508, and the thermal bonding band 112 remain.

The top layer 300 where the first and second partial opening tabs 102 and 502, the first and second partial opening guide-separating lines 104 and 504, the first and second partial separating lines 106 and 506, the first and second opening guide-separating bands 108 and 508, and the thermal bonding band 112 are formed is thermally bonded to a bottom layer 400.

It can be seen that the first and second partial opening tabs 102 and 502 are formed at the left and right halves of the top, respectively.

Further, it can be seen that the first and second partial opening tabs 102 and 502 are formed symmetrically with the center point of the top therebetween.

Obviously, several opening tabs and various shapes of opening tabs may be provided, if necessary.

Referring to FIG. 8 again, thermal bonding is performed only on the thermal bonding band 112 that is bonded to an actual container and the first and second partial opening guide-separating bands 108 and 508, except for the first and second partial opening tabs 102 and 502. As described above, the top layer 300 and the bottom layer 400 are thermally bonded only at the first and second partial opening guide-separating bands 108 and 508 and the thermal bonding band 112, and then the container seal 100 is achieved by performing cutting or punching along the outermost separating line 110 to meet the standard of the container.

Figure 10:
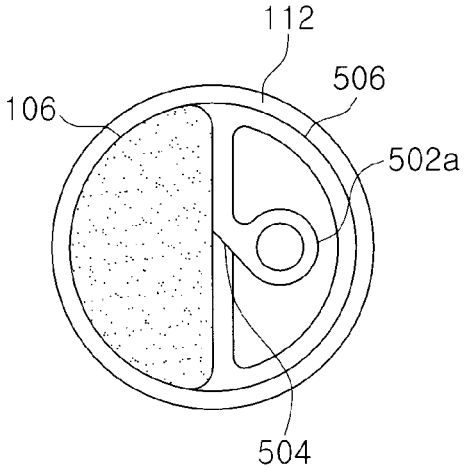
Figure 11:
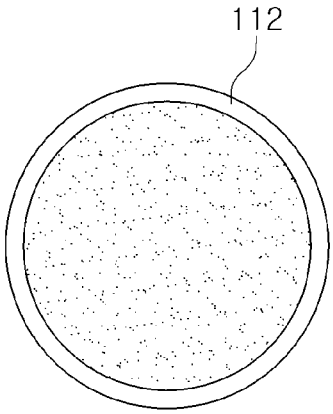

FIGS. 9 to 11 are views sequentially showing a process of opening a container seal 100 according to the present invention;

Referring to FIG. 9 first, the left half of the container seal 100 is opened by pulling the first partial opening tab 102. When the upper portion 102*a* of the first partial opening tab 102 is pulled, the bottom layer 104 starts tearing from the first partial opening guide-separating line 104 at the neck of the first partial opening tab 102 and then the first partial separating line 106 tears, whereby the left semicircular part is opened (FIG. 10).

Next, as shown in FIG. 10, the right half of the container seal 100 is opened by pulling the upper portion 502*a* of the second partial opening tab 502. As the upper portion 502*a* of the second partial opening tab 502 is pulled, the container seal tears along the second partial separating line 506.

As a result, as the right half is removed, the opening tab 100 is fully opened, as shown in FIG. 11.

When the first partial opening tab is removed, the second partial opening tab is partially cut, so the container seal is easily separated along the partial separating line to be fully opened in the second step.

Next, the thermal bonding band 111 is left at the end of the container entrance, as shown in FIG. 11.

Figure 12:
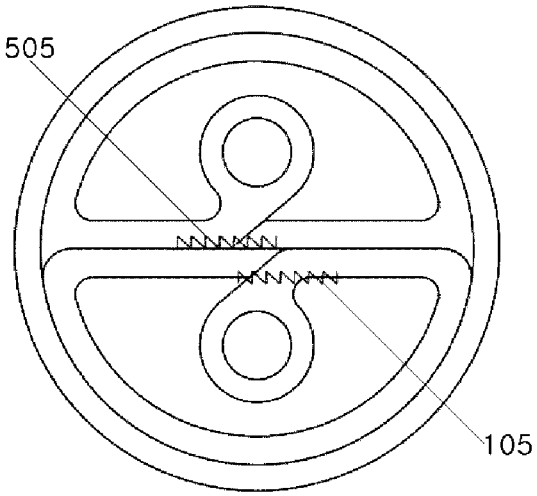
FIG. 12 is a view showing wave lines on a thermal bonding layer right under separating lines.

Referring to FIG. 12, third opening guide-separating lines 105 and 505 are formed in the shape of a straight line or a wave line at the lower portions of the opening guide-separating lines or the start points where the opening tabs are separated from the bottom layer, on the thermal bonding layer of the bottom layer, using a carbon dioxide laser having a wavelength of 10,600 micrometer or a UV laser having a wavelength of 352 micrometers.

Accordingly, it is possible to easily remove the sealing tabs even with small force by pulling the handle of the opening tabs.

FIGS. 13 to 20 are views showing a process of applying a container seal according to the present invention.

Figure 13:
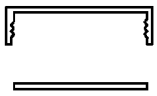
FIGS. 13 to 20 are views showing a process of applying a container seal according to the present invention.

FIG. 13 shows the container seal 100 and a cap that are separated from each other.

Figure 14:
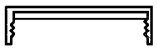

Referring to FIG. 14, the container seal 100 is put inside the cap.

Figure 15:
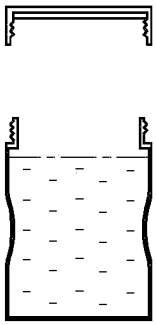

FIG. 15 shows a container seal inserted in a cap and a container filled with contents.

Figure 16:
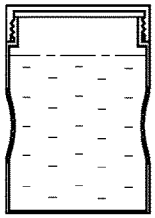

Referring to FIG. 16, the cap and the container shown in FIG. 15 have been combined.

Figure 17:
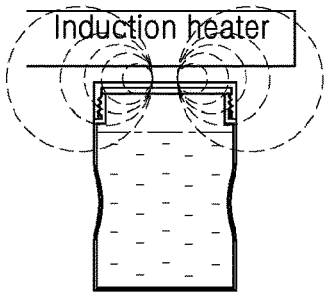

Referring to FIG. 17, the container shown in FIG. 16 is sealed through an induction heater.

Figure 18:
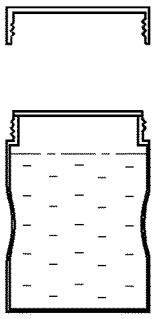

FIG. 18 shows a process when a user opens the cap to use the container sealed with the container sea 100 by induction heat in FIG. 17.

Figure 19:
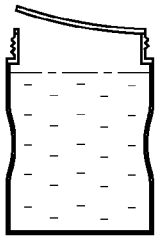

Referring to FIG. 19, a customer partially or fully opens the container sea by pulling the partial opening tabs of the present invention to take out the contents in the container.

Figure 20:
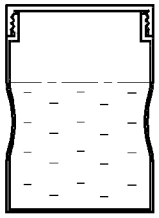

Referring to FIG. 20, the container is sealed back by closing the cap with some of the contents left after opening.

Figure 21:
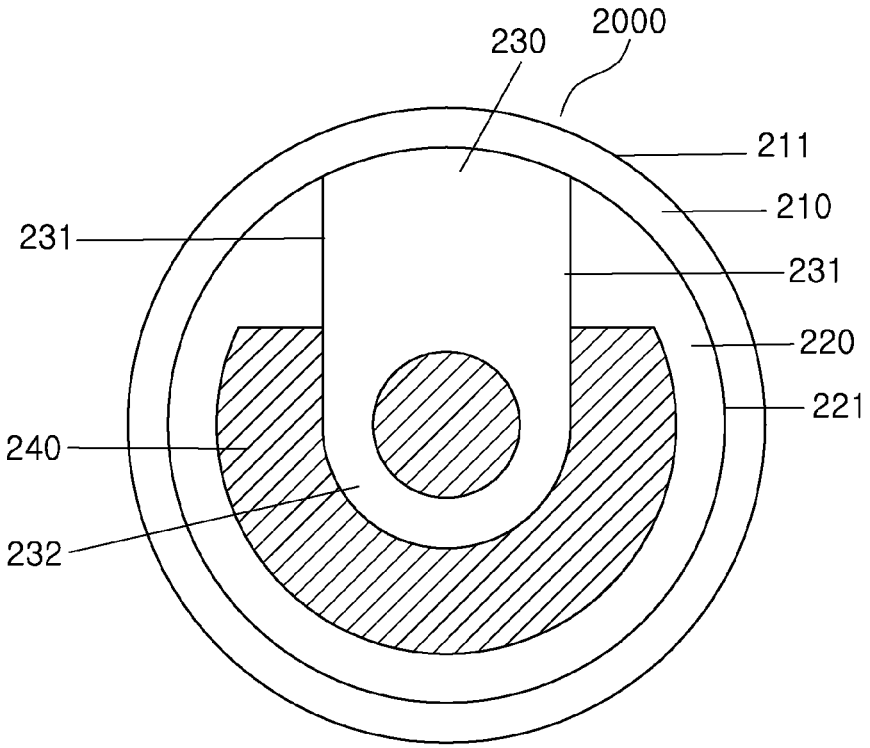
FIG. 21 is a perspective view showing a container seal according to a second embodiment of the present invention.
Figure 22:
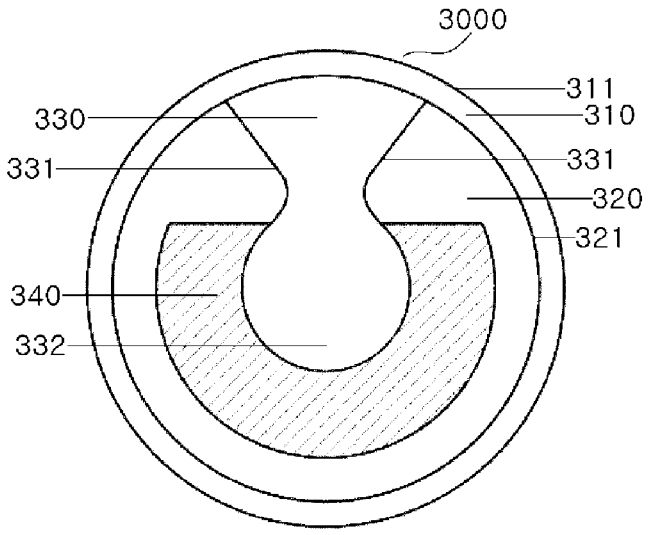
FIG. 22 is a perspective view showing a container seal according to a third embodiment of the present invention.

FIGS. 21 and 22 are perspective views container seals according to two embodiments, that is, a second embodiment and a third embodiment of the present invention. The embodiments are discriminated by the shapes of the seal.

The container seals are configured to seal a container entrance by thermal bonding and to open the container entrance when the opening tab on the top is pulled.

The container seals, which have partial opening tabs 230 and 330, respectively, can be partially opened along opening guide-separating lines 231 and 331 when the partial opening tabs 230 and 330 are pulled up and the partial opening tabs 230 and 330 separated along the opening guide-separating lines 231 and 331 are completely separated from a container by separating lines 221 and 321. In order to fully open the container seals after the partial opening tabs 230 and 330 are partially opened, a user has only to pull up the opening tabs because opening guide-separating bands 220 and 320 are open at the left and right sides.

The container seals further include ring-shaped thermal bonding bands 210 and 310 that are separated from the opening guide-separating bands 220 and 320 by opening guide-separating lines 231 and 331 and are thermally bonded to the lip of the entrance of a container outside the opening guide-separating bands.

The process of making the container seals according to the present invention is the same as that described with reference to FIGS. 5 to 7.

Figure 23:
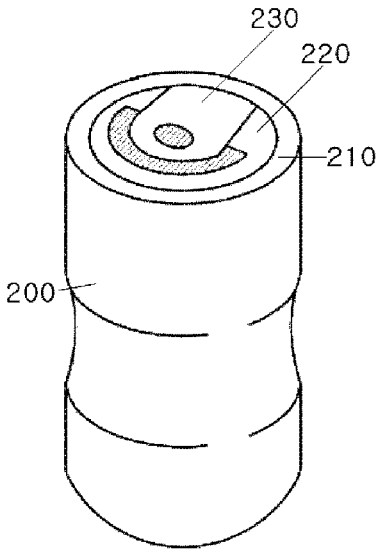
FIGS. 23 to 26 are views sequentially showing a process of opening the container seal according to the second embodiment of the present invention that has been applied to a container.

Referring to FIG. 23, which shows the second embodiment, the entrance of a container 200 is sealed by a container seal 2000 according to the present invention.

Figure 24:
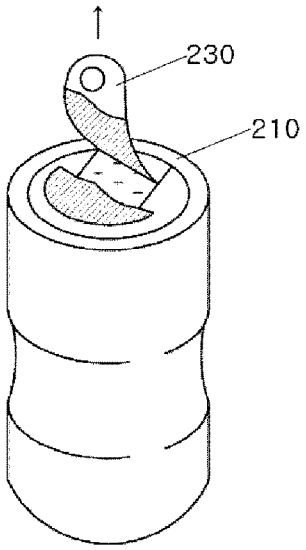

FIG. 24 is a view the container seal according to the second embodiment when an opening tab is pulled to open the entrance of the container.

Figure 25:
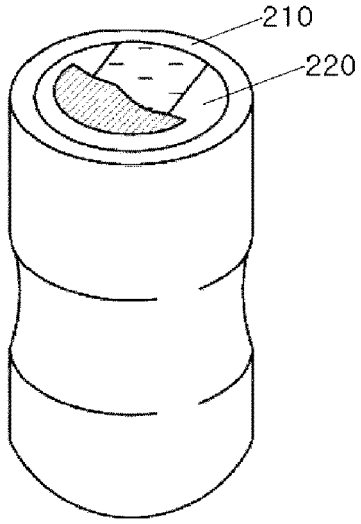

FIG. 25 shows the container seal that has been partially open, which is fully opened, if necessary.

When an upper portion 332 of a partial opening tab on a container seal 3000 according to the third embodiment is pulled, partial opening by the third embodiment is made by an opening guide-separating line 331, similar to FIG. 25 showing the second embodiment.

Figure 26:
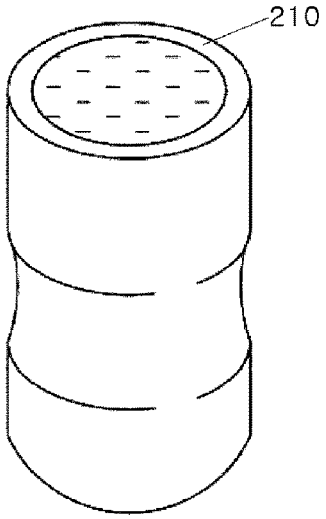

Referring to FIG. 26, cut spaces are made at the left and right of the opening tab that has been partially opened after the partial opening, so when a user pulls up the opening guide-separating bands 220 and 320 in open aluminum layers by hand, the container seals are separated.

Figure 27:
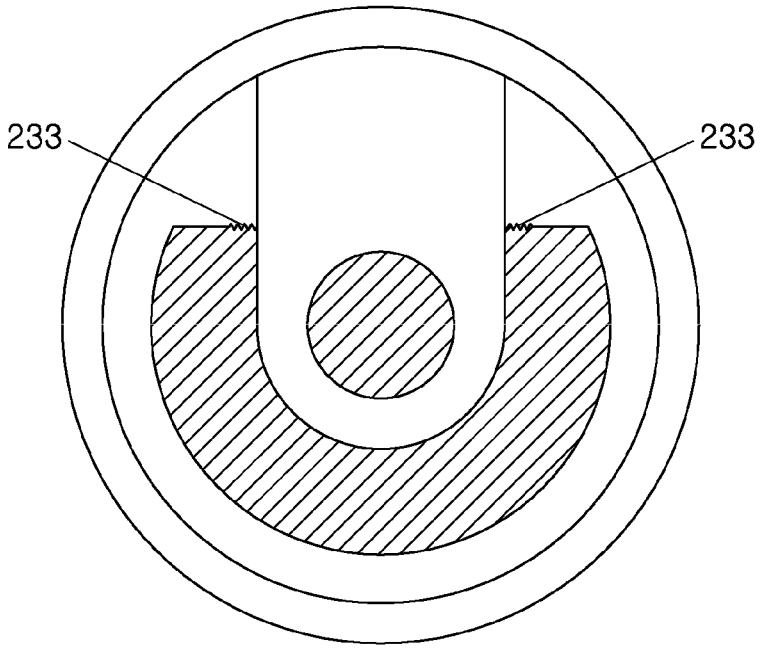
FIG. 27 is a view showing wave lines on a thermal bonding layer directly under separating lines according to the second embodiment.
Figure 28:
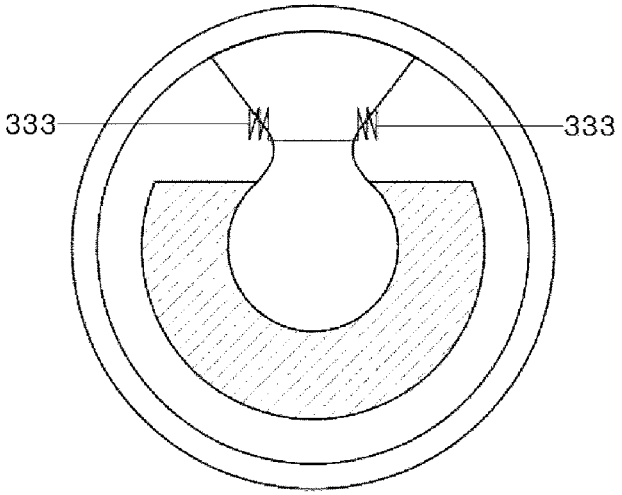
FIG. 28 is a view showing wave lines on a thermal bonding layer directly under separating lines according to the third embodiment.

Referring to FIGS. 27 and 28 showing the seals of the second and third embodiments, third opening guide-separating lines 233 and 333 are formed in the shape of a straight line or a wave line at lower portions of the opening guide-separating lines or the start point where the opening tabs are separated from the bottom layer using a carbon dioxide laser having a wavelength of 10,600 micrometers or a UV laser having a wavelength of 352 micrometers, on thermal bonding layers of the aluminum bottom layer right under the portions where the opening guide-separating lines of the top layers start from the tab.

Accordingly, a user can open the closing tabs even with small force using the opening tabs 230 and 330.

FIGS. 13 to 20 show a process of applying the container seal according to the first embodiment of the present invention and the process is applied in the same way, as described above, to the second and third embodiments.

Figure 29:
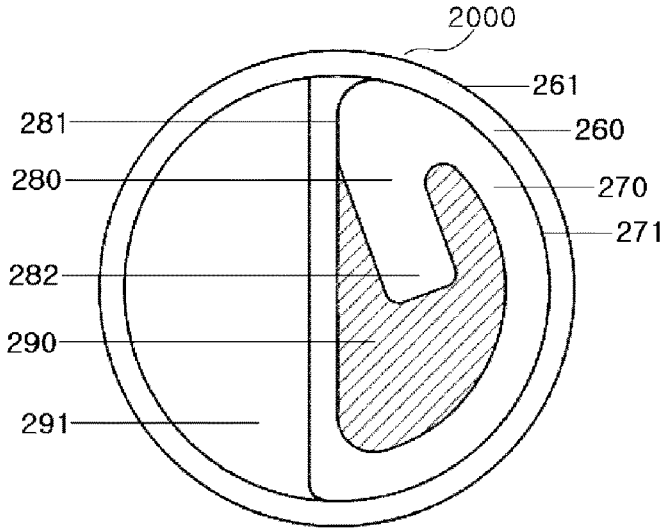
FIG. 29 is a perspective view showing a container seal according to a fourth embodiment of the present invention.
Figure 30:
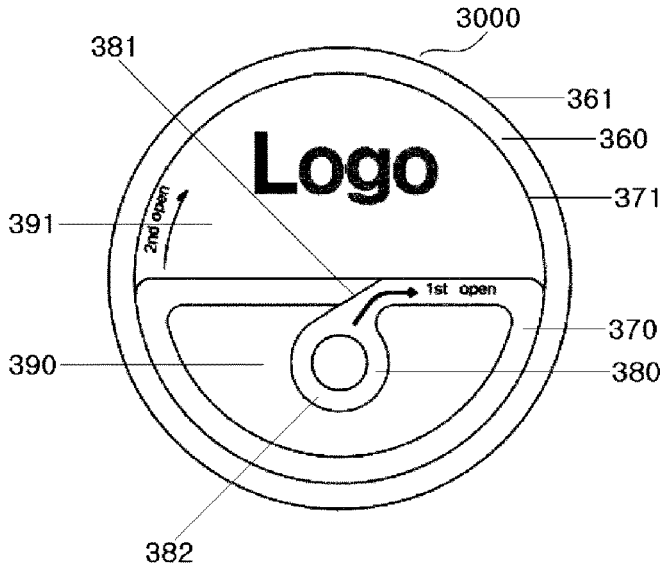
FIG. 30 is a view showing a container seal according to a fifth embodiment of the present invention.

FIGS. 29 and 30 are perspective views showing container seals according to fourth and fifth embodiments of the present invention.

The container seals are configured to seal a container entrance by thermal bonding and to open the container entrance when the opening tab on the top is pulled.

The container seals have partial opening tabs 280 and 380, respectively, so when the half opening tabs 280 and 380 are pulled up, opening starts at opening guide-separating lines 281 and 381 and continues along separating lines 271 and 371 so that the container seals are opened half. The partial opening tabs 280 and 380 separated along the opening guide-separating lines 281 and 381 and the separating lines 271 and 371 are completely separated from a container by the separating lines 271 and 371.

In order to fully open the container seals after the partial opening tabs 280 and 380 are partially opened, a user has only to pull up the opening tabs because sides of opening guide-separating bands 220 and 320 are fully open.

The opening tabs 291 and 391 remaining after the primary opening has a half shape.

A company logo or advertisements of products can be printed on them.

The opening guide-separating bands are generally rounded at the corners for easy opening.

The container seals further include ring-shaped thermal bonding bands 260 and 360 that are separated from the opening guide-separating bands 270 and 370 by opening guide-separating lines 281 and 381 and are thermally bonded to the lip of the entrance of a container outside the opening guide-separating bands.

The method of manufacturing the container seals is the same as that described above with reference to FIGS. 5 to 7.

The container seals are composed of a top layer and a bottom layer.

The container seals include: a top layer 300 having the opening tabs; and a bottom layer 400 thermally bonded to an aluminum foil and a container, in which the top layer is thermally bonded to the bottom layer.

The container seals are manufacture through a first step of forming opening guide-separating band 270 and 370 defined by partial opening tabs 280 and 380, opening guide-separating lines 281 and 381, and separating lines 271 and 371, and thermal bonding bands 260 and 360 by cutting outermost separating lines 261 and 361, on the top layer; a second step of removing unnecessary portions 290 and 390 formed in the first step; and a step of thermally bonding the top layer prepared in the first and second steps to the bottom layer.

FIGS. 5 to 7 show a process of making the container seal according to the first embodiment of the present invention. This process is applied in the same way to the fourth and fifth embodiments.

Figure 31:
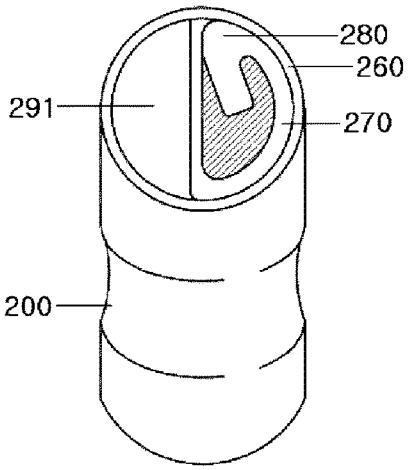
FIGS. 31 to 34 are views sequentially showing a process of opening the container seal according to the fourth embodiment of the present invention that has been applied to a container.

Referring to FIG. 31, which shows the fourth embodiment, the entrance of a container 200 is sealed by a container seal 2000 according to the present invention.

Figure 32:
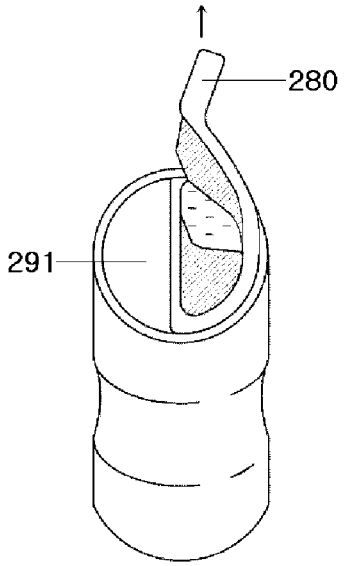

FIG. 32 is a view the container seal according to the fourth embodiment when an opening tab is pulled to open the entrance of the container.

Figure 33:
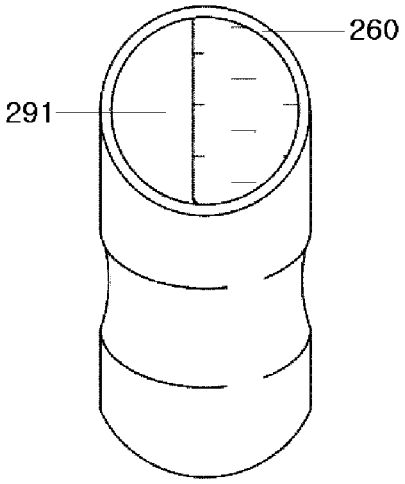

When the partial opening tabs 280 and 380 on the tops of the container seals 2000 and 3000, partial opening is made along the opening guide-separating lines 281 and 381 (FIG. 33).

Figure 34:
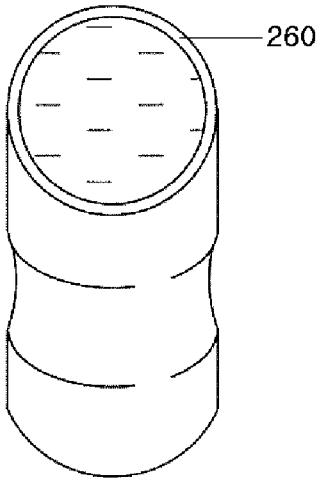

Referring to FIG. 34, a partial cut space is formed at a side of the opening tabs, which have been partially open, after the partial opening, so when the opening guide-separating bands 291 and 391 corresponding to a half the container entrance are pulled up, the remaining container seals are separated.

Figure 35:
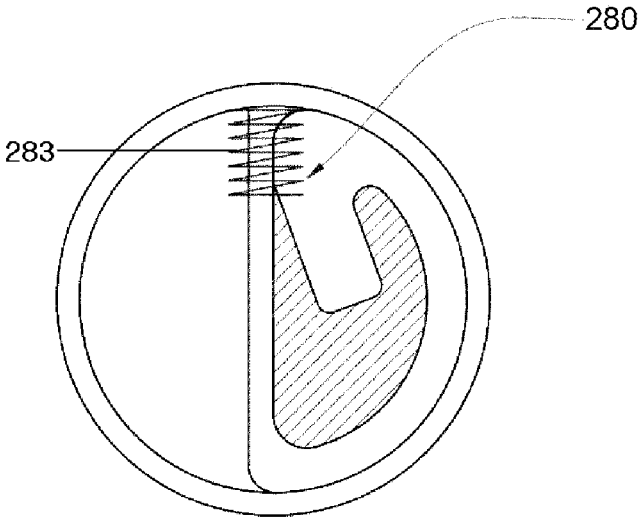
FIG. 35 is a view showing wave lines on a thermal bonding layer directly under separating lines according to the fourth embodiment.
Figure 36:
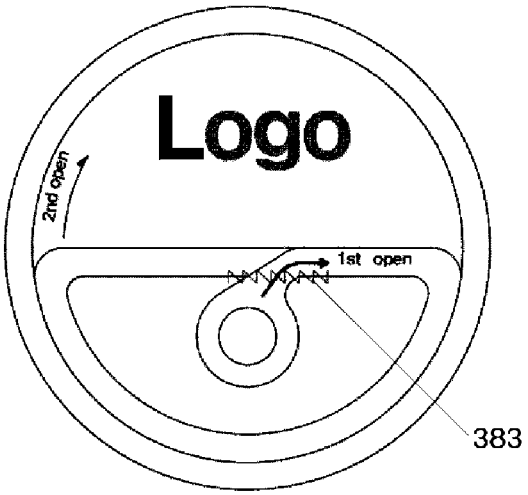
FIG. 36 is a view showing wave lines on a thermal bonding layer directly under separating lines according to the fifth embodiment.

Referring to FIGS. 35 and 36 showing the fourth and fifth embodiments, third opening guide-separating lines 283 and 383 are formed in the shape of a straight line or a wave line at lower portions of the opening guide-separating lines or the start point where the opening tabs are separated from the bottom layer using a carbon dioxide laser having a wavelength of 10,600 micrometers or a UV laser having a wavelength of 352 micrometers, on thermal bonding layers of the aluminum bottom layer right under the portions where the opening guide-separating lines of the top layers are formed.

Accordingly, a user can open the closing tabs even with small force using the opening tabs 280 and 380.

The process of applying these container seals is the same as that described with reference to FIGS. 13 to 20.

According to the container seal of the present invention, it is possible obtain a primary sealing effect before opening a container and the container seal partially remains at the lip of a container entrance even after the container is opened, so when a container is closed again by a cap, the container and the cap are brought in close contact with each other by elasticity and shock-absorbing ability of the container seal. Accordingly, it is possible to achieve a secondary sealing effect that prevents inflow of oxygen and moisture, in addition to preventing leakage of contents.

Further, according to the container seal of the present invention, since it is possible to print a company logo or advertisement of a product in the area except for the partial opening tabs on the top of the seal, an advertising effect can be maximized until a user uses up the contents in the container after removing the partial opening tabs.

The present invention provides a container seal that can partially or elliptically open a container entrance to meet the use in a first step and fully open the container entrance in a second step, to the industrial applicability of the container seal is high.

Further, for another configuration that increases the industrial applicability, the present invention provides a thermal seal that can provide consumers with convenience, reliability, and safety by having a structure capable of being easily opened and providing a certain temper evident with an opening trace left.

What is claimed is:

1. A container seal comprising:

a top layer; and a bottom layer to be thermally bonded to a container together with aluminum foil, wherein:

the top layer has a plurality of partial opening tabs connected to a plurality of partial opening guide-separating bands, respectively, the partial opening guide-separating bands are connected to the partial opening tabs with a plurality of opening guide-separating lines as outer boundaries, and portions of a thermal bonding band and the top layer are cut so that the partial opening guide-separating bands are to be separated along an inner edge of the container, and the top layer is thermally bonded to the bottom layer, wherein the partial opening tabs include a first partial opening tab and a second partial opening tab symmetrical with the first partial opening tab.

2. The container seal of claim 1, wherein the partial opening guide-separating bands include a first partial opening guide-separating band and a second partial opening guide-separating band, and the opening guide-separating lines include a first opening guide-separating line and a second opening guide-separating line.

3. The container seal of claim 2, wherein:

the thermal bonding band is ring-shaped, the thermal bonding band is separated from the first partial opening guide-separating band and the second partial opening guide-separating band by a first partial separating line and a second partial separating line, and the thermal bonding band is to be thermally bonded to a lip of the container outside the first opening guide-separating band and the second partial opening guide-separating band.

4. The container seal of claim 3, wherein portions of the first partial opening tab and the second partial opening tab in contact with the first opening guide-separating line and the second opening guide-separating line, the first opening guide-separating band and the second opening guide-separating band and the thermal bonding band are to have predetermined widths inside an edge of the container and are thermally bonded to the bottom layer.

5. The container seal of claim 2, wherein a third opening guide-separating line is defined on a thermal bonding layer of the bottom layer where one of the opening guide-separating lines is arranged at a position where one of the partial opening tabs and one of the partial separating lines meet each other.

6. The container seal of claim 3, wherein a third opening guide-separating line is defined on a thermal bonding layer of the bottom layer where one of the opening guide-separating lines is arranged at a position where one of the partial opening tabs and one of the partial separating lines meet each other.

7. The container seal of claim 4, wherein a third opening guide-separating line is defined on a thermal bonding layer of the bottom layer where one of the opening guide-separating lines is arranged at a position where one of the partial opening tabs and one of the partial separating lines meet each other.

8. The container seal of claim 1, wherein another opening guide-separating line is defined on a thermal bonding layer of the bottom layer where one of the opening guide-separating lines is arranged at a position where one of the partial opening tabs and one of the partial separating lines meet each other.

9. A container seal comprising:

a top layer; and a bottom layer to be thermally bonded to a container together with an aluminum foil layer, wherein:

the top layer has a first partial opening tab and a second partial opening tab symmetrical with the first partial opening tab, is thermally bonded to the bottom layer, and has an opening guide-separating line for partially opening the top layer when the first partial opening tab is pulled up, the first partial opening tab separated along the opening guide-separating line is to be separated from the container by a separating line, a ring-shaped thermal bonding band is spaced from an opening guide-separating band by the opening guide-separating line and is to be thermally bonded to a lip of the container outside the opening guide-separating band, and the opening guide-separating band, a side adjacent to the separating line of the first partial opening tab, and the thermal bonding band are thermally bonded to the bottom layer, wherein another opening guide-separating line is defined on a thermal bonding polymer layer of the bottom layer right under a portion where the first partial opening tab and the opening guide-separating line where an opening is to be started are arranged.

10. The container seal of claim 9, wherein, in a state in which the fit partial opening tab is partially opened, the opening guide-separating band is open at a left side and a right side such that the container seal is fully opened by pulling up any one of the left side and the right side.

11. A container seal comprising:

a top layer; and a bottom layer to be thermally bonded to a container together with an aluminum foil layer, wherein:

the top layer has a first partial opening tab and a second partial opening tab symmetrical with the first partial opening tab, is thermally bonded to the bottom layer, is configured to start opening along an opening guide-separating line so as to be partially opened along an opening guide-separating band when the first partial opening tab is pulled up, and is configured to be fully opened when being pulled up in any direction by a side of the opening guide-separating band being open after the first partial opening tab is partially opened, and a ring-shaped thermal bonding band is to be thermally bonded to a lip of the container outside the opening guide-separating band, wherein another opening guide-separating line is defined on a thermal bonding layer of the bottom layer right under a portion where the first partial opening tab and the opening guide-separating line where an opening is to be started are arranged.

* * * * *